US007284807B2

(12) United States Patent
Ishihara

(10) Patent No.: US 7,284,807 B2
(45) Date of Patent: Oct. 23, 2007

(54) WASTE LIQUID QUANTITY DETECTING METHOD, WASTE LIQUID QUANTITY DETECTING DEVICE, AND LIQUID DISCHARGING APPARATUS

(75) Inventor: Mitsugu Ishihara, Kanagawa (JP)

(73) Assignee: Sony Corporation, Tokyo (JP)

( * ) Notice: Subject to any disclaimer, the term of this patent is extended or adjusted under 35 U.S.C. 154(b) by 314 days.

(21) Appl. No.: 10/870,502

(22) Filed: Jun. 17, 2004

(65) Prior Publication Data

US 2005/0018000 A1 Jan. 27, 2005

(30) Foreign Application Priority Data

Jun. 20, 2003 (JP) ..... P2003-175916

(51) Int. Cl.
*B41J 2/195* (2006.01)
*B41J 29/393* (2006.01)
*B41J 2/165* (2006.01)

(52) U.S. Cl. ..... 347/7; 347/19; 347/36

(58) Field of Classification Search ..... 347/7
See application file for complete search history.

(56) References Cited

U.S. PATENT DOCUMENTS

2002/0118236 A1* 8/2002 Uetsuki ..... 347/7
2003/0058297 A1* 3/2003 Saruta ..... 347/7

FOREIGN PATENT DOCUMENTS

JP 2755791 3/1998

* cited by examiner

*Primary Examiner*—Matthew Luu
*Assistant Examiner*—Jannelle M. Lebron
(74) *Attorney, Agent, or Firm*—Sonnenschein Nath & Rosenthal LLP

(57) ABSTRACT

A device detects a quantity of waste liquid without using a special sensor by subtracting total use of liquid from total consumption of liquid and regarding the differential as the quantity of waste liquid. The device includes a first unit for accumulating liquid consumption for a period from the start of using a liquid container up to the present to obtain and store total consumption, a second unit for accumulating liquid quantity used for the operation by the operation unit for the period to obtain and store total use, a third unit for subtracting the total use from the total consumption to obtain the waste liquid quantity, a fourth unit for comparing the obtained waste liquid quantity with a predetermined upper limit on waste liquid quantity, and a fifth unit for informing that the waste liquid quantity exceeds the upper limit.

2 Claims, 12 Drawing Sheets

WASTE LIQUID QUANTITY DETECTING METHOD, WASTE LIQUID QUANTITY DETECTING DEVICE, AND LIQUID DISCHARGING APPARATUS

RELATED APPLICATION DATA

The present application claims priority to Japanese Application(s) No(s). P2003-175916 filed Jun. 20, 2003, which application(s) is/are incorporated herein by reference to the extent permitted by law.

BACKGROUND OF THE INVENTION

1. Field of the Invention

When liquid is supplied from a liquid container to an operation unit and is consumed, the liquid is partially wasted without being used for the operation. The present invention relates to a method for detecting quantity of the waste liquid and a liquid discharging apparatus.

2. Description of the Related Art

The hitherto known ink jet printer has a so-called serial type print head, which is shorter than the width of the printed area of a recording sheet and reciprocates in the widthwise direction of the recording sheet to perform printing.

Such an ink jet printer performs nozzle cleaning in order to prevent clogging of ink discharging nozzles and defective printing caused thereby. For the nozzle cleaning, a waste ink receiver and a head cap with an ink sucking mechanism are provided laterally away from the recording sheet. The print head moves to the waste ink receiver to discharge ink thereto in vain. In addition, the print head moves to the ink sucking mechanism to allow ink to be sucked.

Such nozzle cleaning is easily performed by the ink jet printer with a serial type print head. Since the number of nozzles is small, the quantity of ink received by the waste ink receiver is small. Therefore, the waste ink becomes dry easily, and it is not necessary to replace the waste ink receiver regularly.

Recently, a so-called full-line type print head has been provided. It has a length that allows it to cover the entire width of a recording sheet (for example, an A4 recording sheet).

The full-line type print head has a row of ink discharging nozzles having substantially the same length as the width of the printed area of the recording sheet. If an ink jet printer having the full-line type print head performs the above-described nozzle cleaning, the quantity of ink received by the waste ink receiver is greater than that of the ink jet printer having the serial type print head. Therefore, it is necessary to replace the waste ink receiver regularly.

In this case, it is necessary to inform the user of time to replace the waste ink receiver. A technology for informing the user of time to replace the waste ink receiver is disclosed in, for example, Japanese Patent No. 2755791 (p. 1, FIG. 5). In the technology, the accumulated number of times of nozzle clearing operation is counted, and the counted number of times is stored. Before every nozzle clearing operation, the stored number of times is read out, and it is determined whether the waste ink receiver is still capable of accommodating the waste ink to be discharged in the nozzle clearing operation. If the determination is negative, a warning is given to urge the user to replace the waste ink receiver.

However, this technology has a problem in which the structure is complex and the cost is expensive because it is necessary to provide the waste ink receiver with a special sensor for counting the accumulated number of times of nozzle clearing operation.

SUMMARY OF THE INVENTION

Accordingly, in order to overcome such a problem, it is an object of the present invention to provide a waste liquid quantity detecting method, a waste liquid quantity detecting device, and a liquid discharging apparatus that are simple and capable of detecting a quantity of waste liquid by subtracting the total use of liquid from the total consumption of liquid for the duration of use of a liquid container holding a predetermined type of liquid and by regarding the differential as the quantity of waste liquid.

In order to achieve this object, according to one aspect of the present invention, there is provided a method for detecting a quantity of waste liquid which is not used in a predetermined operation when a predetermined type of liquid is supplied from a liquid container to an operation unit performing the predetermined operation and is consumed, the method including the steps of accumulating liquid consumption for a period from the start of using the liquid container up to the present to obtain total consumption (T), accumulating liquid quantity used for the operation by the operation unit for the period to obtain total use (P), subtracting the total use (P) from the total consumption (T), and obtaining quantity (D) of the waste liquid by regarding the subtraction result (T−P) as the quantity (D) of the waste liquid. This method is simple.

According to another aspect of the present invention, there is provided a device for detecting a quantity of waste liquid which is not used in a predetermined operation when a predetermined type of liquid is supplied from a liquid container to an operation unit performing the predetermined operation and is consumed, the device including a first unit for accumulating liquid consumption for a period from the start of using the liquid container up to the present to obtain and store total consumption, a second unit for accumulating liquid quantity used for the operation by the operation unit for the period to obtain and store total use, a third unit for subtracting the total use from the total consumption to obtain the waste liquid quantity, a fourth unit for comparing the obtained waste liquid quantity with a predetermined upper limit on waste liquid quantity, and a fifth unit for informing that the waste liquid quantity exceeds the upper limit.

Since this device does not have a special sensor, the structure is simple and the cost is inexpensive.

According to another aspect of the present invention, there is provided a liquid discharging apparatus including a liquid discharging head supplied with a predetermined type of liquid from a liquid container and held detachably in an apparatus body, the liquid discharging head having a liquid discharging nozzle discharging the liquid to form dots or rows of dots, the apparatus detecting a quantity of the liquid wasted without being used for forming the dots or rows of dots, the apparatus further including a first unit for accumulating liquid consumption for a period from the start of using the liquid container up to the present to obtain and store total consumption, a second unit for accumulating liquid quantity used for forming the dots or the rows of dots by the liquid discharging nozzle for the period to obtain and store total use, a third unit for subtracting the total use from the total consumption to obtain the waste liquid quantity, a fourth unit for comparing the obtained waste liquid quantity with a predetermined upper limit on waste liquid quantity, and a fifth unit for informing that the comparison result exceeds a predetermined value.

Since this apparatus does not have a special sensor, the structure is simple and the cost is inexpensive.

According to another aspect of the present invention, there is provided a liquid discharging apparatus including an apparatus body; a liquid discharging head supplied with a predetermined type of liquid from a liquid container and held detachably in the apparatus body, a nozzle surface of the liquid discharging head having a plurality of liquid discharging nozzles discharging the liquid to form dots or rows of dots; a head cap having a cleaning member wiping the nozzle surface and a waste liquid receiver receiving the liquid discharged in vain from the liquid discharging nozzles, the head cap moving relative to the liquid discharging head to cover or uncover the liquid discharging head and protecting the nozzle surface; a first unit for accumulating liquid consumption for a period from the start of using the liquid container up to the present to obtain and store total consumption; a second unit for accumulating liquid quantity used for forming the dots or the rows of dots by the liquid discharging nozzle for the period to obtain and store total use; a third unit for subtracting the total use from the total consumption to obtain the waste liquid quantity discharged in vain to the waste liquid receiver of the head cap; a fourth unit for calculating the quantity of the liquid absorbed by the cleaning member when the cleaning member wipes the nozzle surface; a fifth unit for comparing the obtained quantity of the liquid absorbed by the cleaning member with a predetermined upper limit on the quantity of the absorbed liquid; a sixth unit for accumulating the quantity of the liquid received by the waste liquid receiver of the head cap; a seventh unit for comparing the accumulated quantity of the received liquid with a predetermined upper limit on the quantity of the liquid received by the waste liquid receiver; and an eighth unit for examining the comparison results output from the fifth unit and the seventh unit, and if necessary, urging to replace the head cap.

Since this apparatus does not have a special sensor, the structure is simple and the cost is inexpensive.

An output signal from the eighth unit may be sent to a display which is provided in the apparatus body and displays the operating condition of the apparatus. The user can replace the head cap at the right time by looking at the notice on the display.

Alternatively, an output signal from the eighth unit may be sent to a display of an information processor connected to the apparatus body and displaying the contents of information processing. The user can replace the head cap at the right time by looking at the notice on the display.

DESCRIPTION OF THE PREFERRED EMBODIMENTS

The preferred embodiments of the present invention will now be described with reference to the drawings.

Figure 1:
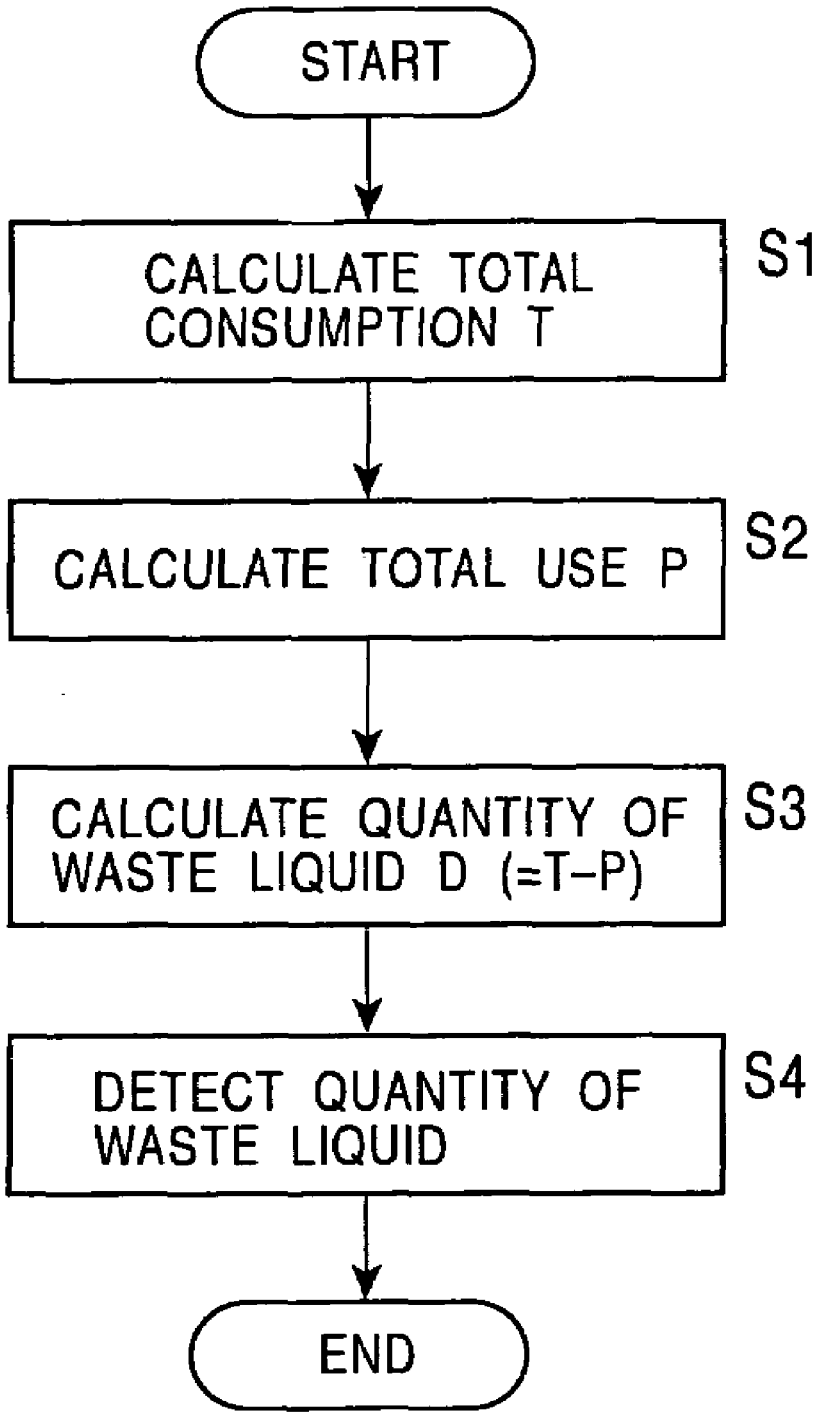
FIG. 1 is a flow chart showing an embodiment of a detecting method according to the present invention.

FIG. 1 is a flow chart showing an embodiment of a detecting method according to the present invention. The method is used when a predetermined type of liquid is supplied from a liquid container to an operation unit performing a predetermined operation and is consumed. The method is for detecting quantity of the liquid wasted without being used for the operation. The method is used in, for example, a print head of an ink jet printer. In this case, the predetermined type of liquid is ink, the liquid container is an ink tank, the operation unit is an ink discharging nozzle, and the predetermined operation is forming dots or rows of dots for printing on a recording sheet.

As shown in FIG. 1, first, liquid consumption for a period from the start of using the liquid container up to the present is accumulated to obtain total consumption T (step S1). The total consumption T of the liquid is calculated according to formula (1):

$$T=V(N+1)-R \tag{1}$$

where V is the capacity of the liquid container, N is the number of times of refilling or replacing the liquid container, and R is the quantity of the liquid remaining in the current liquid container, the quantity R being detected by a liquid remaining quantity detector provided in the liquid container.

The "refilling" means filling an empty container with liquid again without removing the container.

The "replacing" means removing an empty container and placing a new filled container. The liquid remaining quantity detector for detecting the liquid remaining quantity R in the current container is, for example, a known remaining quantity sensor having an electrode probe on the side wall of the ink tank (liquid container).

Next, liquid quantity used for the operation by the operation unit is accumulated for the period from the start of using the liquid container up to the present to obtain total use P (step S2). The total use P of the liquid is calculated according to formula (2):

$$P=M\cdot L \tag{2}$$

where M is the total number of drops of the liquid used for the operation by the operation unit, and L is the volume of a drop of the liquid.

The number of drops of the liquid used for the operation is, for example, the number of drops discharged from ink discharging nozzles. This is obtained by counting the number of pulses of the driving signal applied to a driving unit for discharging ink from the ink discharging nozzles. The volume of a drop of the liquid is of the order of a picoliter (pl).

Next, the total use P is subtracted from the total consumption T to obtain the quantity D (=T−P) of the waste liquid (step S3). Although the actual quantity D of the waste liquid is not detected, the subtraction result (T−P) can be regarded as the quantity D of the waste liquid.

Therefore, the quantity D of the waste liquid is detected by regarding the subtraction result (T−P) as the quantity D of the waste liquid (step S4). In this way, the quantity D of the waste liquid can be detected easily without directly detecting the actual quantity D of the waste liquid.

Figure 2:
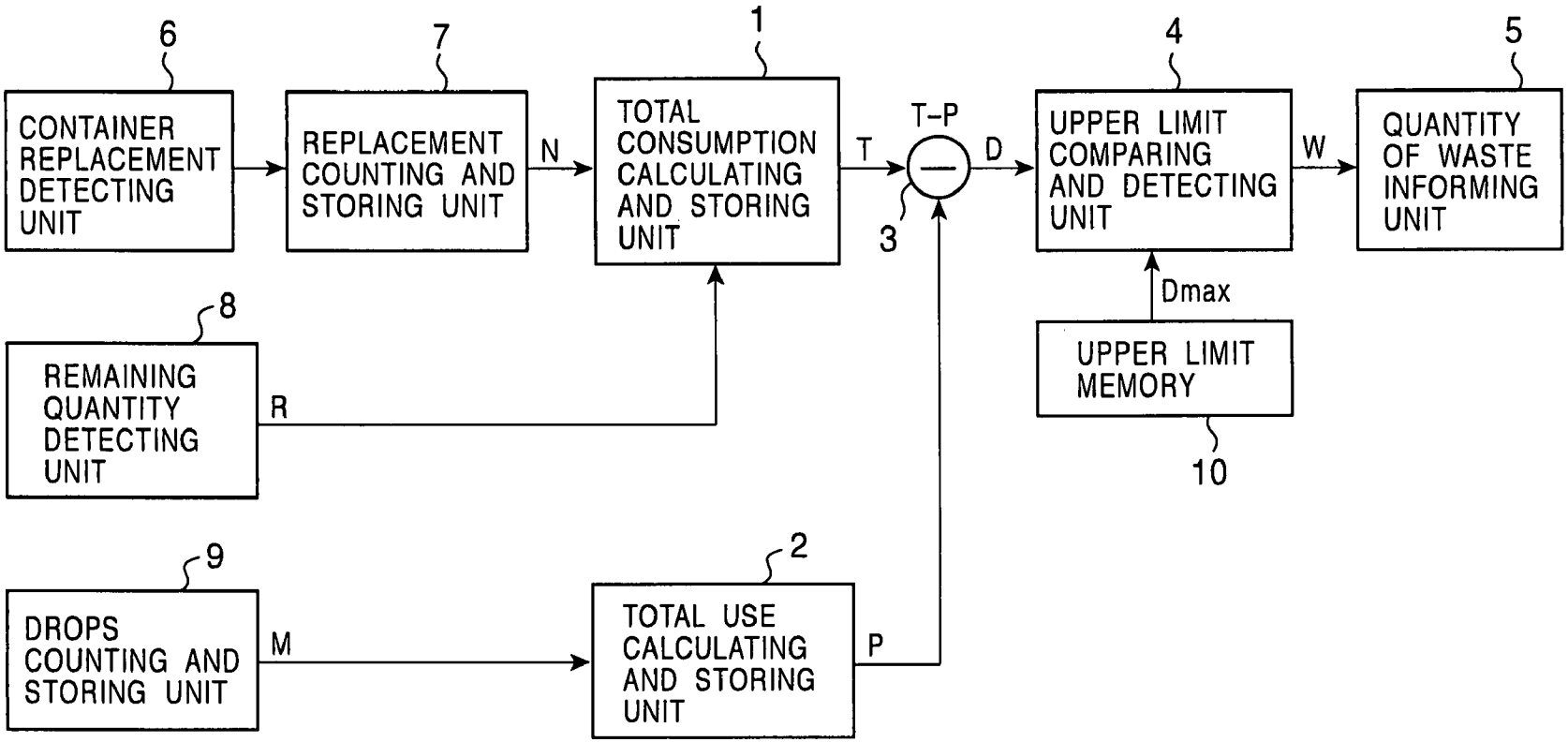
FIG. 2 is a block diagram showing an embodiment of a detecting device according to the present invention, the device being used for the method.

FIG. 2 is a block diagram showing an embodiment of a detecting device according to the present invention, the device being used for the method. The device is used when a predetermined type of liquid is supplied from a liquid container to an operation unit performing a predetermined operation and is consumed. The device is for detecting the quantity of liquid wasted without being used for the operation. As shown in FIG. 2, the device has a total consumption calculating and storing unit 1, a total use calculating and storing unit 2, a calculating unit 3, an upper limit comparing and detecting unit 4, and a quantity of waste informing unit 5.

The total consumption calculating and storing unit 1 accumulates liquid consumption for a period from the start of using the liquid container up to the present to obtain and store total consumption T. Its inputs are connected with a container replacement detecting unit 6, a replacement counting and storing unit 7, and a remaining quantity detecting unit 8.

The container replacement detecting unit 6 detects the number of times of replacing the liquid container. It includes, for example, a known switch detecting presence or absence of an object. It outputs a replacement detection signal with every detection of replacement of the liquid container.

The replacement counting and storing unit 7 counts the number of replacement detection signals received from the container replacement detecting unit 6 and stores the counted value. The counted value is output as a signal of the number N of times of replacement.

The remaining quantity detecting unit 8 detects the remaining quantity R of liquid in the current container. It is, for example, a known remaining quantity sensor having an electrode probe on the side wall of the liquid container, and it outputs a signal of the remaining quantity R of the liquid.

The total consumption calculating and storing unit 1 calculates the total consumption T of the liquid according to formula (1):

$$T=V(N+1)-R \tag{1}$$

where the capacity V of the liquid container is known, the number N of times of replacing the liquid container is received as a signal from the replacement counting and storing unit 7, and the remaining quantity R of the liquid in the current liquid container is received as a signal from the remaining quantity detecting unit 8.

Although, in FIG. 2, the total consumption calculating and storing unit 1 calculates the total consumption T of the liquid from the number N of times of "replacing" the liquid container, the present invention is not limited to this. The unit 1 may calculate the total consumption T of the liquid from the number N of times of "refilling" the liquid container. In this case, a liquid "refilling" detecting unit is provided instead of the container replacement detecting unit 6, and a "refilling" counting and storing unit is provided instead of the replacement counting and storing unit 7.

The total use calculating and storing unit 2 accumulates and stores the liquid quantity used for the operation by the operation unit for the period from the start of using the liquid container up to the present to obtain total use P. Its inputs are connected with a drops counting and storing unit 9.

The drops counting and storing unit 9 counts the number of liquid drops discharged from an operation unit, for example, an ink discharging nozzle and stores the counted value. It counts the number of pulses of the driving signal applied to a driving unit for discharging ink from the ink discharging nozzles, and it outputs a signal of the total count M.

The total use calculating and storing unit 2 calculates the total use P of the liquid according to formula (2):

$$P=M\cdot L \tag{2}$$

where the total count M of drops of the liquid used for the operation by the operation unit is received as a signal from the drops counting and storing unit 9, and L is the volume of a drop of the liquid.

The calculating unit 3 subtracts the total use P from the total consumption T to obtain the quantity D of the waste liquid. It is, for example, a subtracter. It calculates the quantity D of the waste liquid according to formula (3):

$$D=T-P \tag{3}$$

and outputs a signal of the calculation result.

The upper limit comparing and detecting unit 4 compares the quantity D of waste liquid calculated in the calculating unit 3 with a predetermined upper limit Dmax on the quantity of waste liquid. It is, for example, a comparator. It receives a signal of the quantity D output from the calculating unit 3. In addition, it reads out the upper limit Dmax stored in an upper limit memory 10. It compares them, and if the comparison result exceeds a predetermined value, it outputs an informing signal W.

In this case, the comparison result between the quantity D and the upper limit Dmax is whether D is greater than Dmax or not, the differential between D and Dmax, or the proportion of D to Dmax. If D≧Dmax, if the differential between D and Dmax exceeds a predetermined value, or if the proportion of D to Dmax exceeds a predetermined value, an informing signal W is output. The informing signal W may be output if the differential between D and Dmax becomes 0, or if the proportion of D to Dmax becomes 1.

The quantity of waste informing unit 5 receives the informing signal W from the upper limit comparing and detecting unit 4 and informs that the comparison result between the quantity D and the upper limit Dmax exceeds a predetermined value. The unit 5 is, for example, a warning sound maker such as a buzzer, a warning light, or a warning display such as a display panel.

Figure 3:
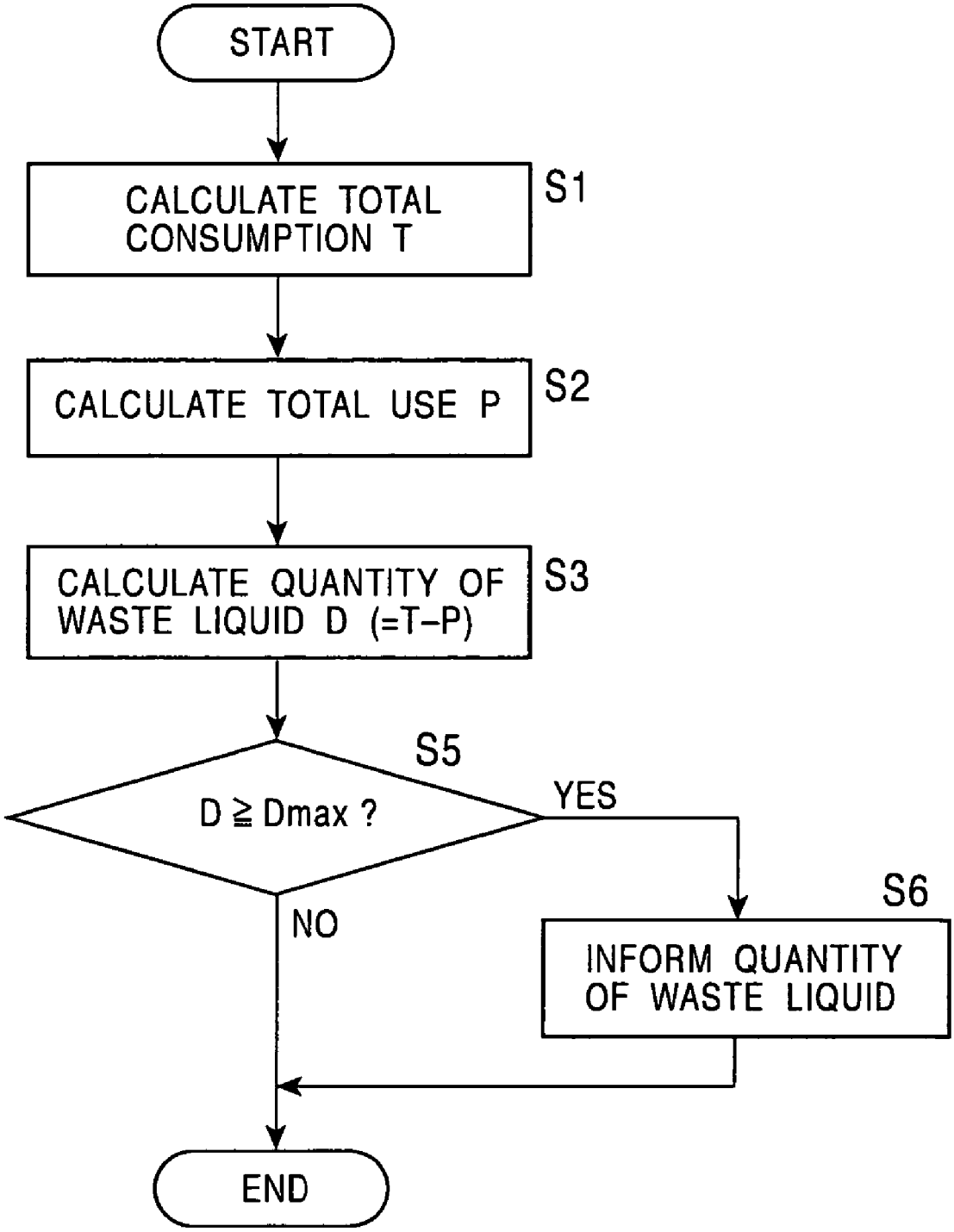
FIG. 3 is a flow chart explaining the operation of the detecting device.

The operation of the waste liquid quantity detecting device will now be described with reference to the flow chart of FIG. 3. The steps S1 to S3 of this flow chart are the same as the steps S1 to S3 of the flow chart shown in FIG. 1.

First, the total consumption calculating and storing unit 1 shown in FIG. 2 calculates the total consumption T of the liquid according to the formula (1) (step S1). Next, the total use calculating and storing unit 2 calculates the total use P of the liquid according to the formula (2) (step S2). Then, the calculating unit 3 subtracts the total use P from the total consumption T to obtain the quantity D of the waste liquid (step S3).

Next, a signal of the quantity D of the waste liquid from the calculating unit 3 and a signal of the upper limit Dmax on the quantity D of the waste liquid from the upper limit memory 10 are input into the upper limit comparing and detecting unit 4 shown in FIG. 2. The unit 4 determines whether D≧Dmax (step S5). If the quantity D of the waste liquid is less than the upper limit Dmax, the operation is continued.

If the quantity D is greater than or equal to the upper limit Dmax, the operation is skipped to step S6. Then, the user is informed that the comparison result between the quantity D and the upper limit Dmax exceeds the predetermined value (step S6). Thus, the user knows that the quantity D exceeds the upper limit Dmax and takes necessary measures.

Figure 4:
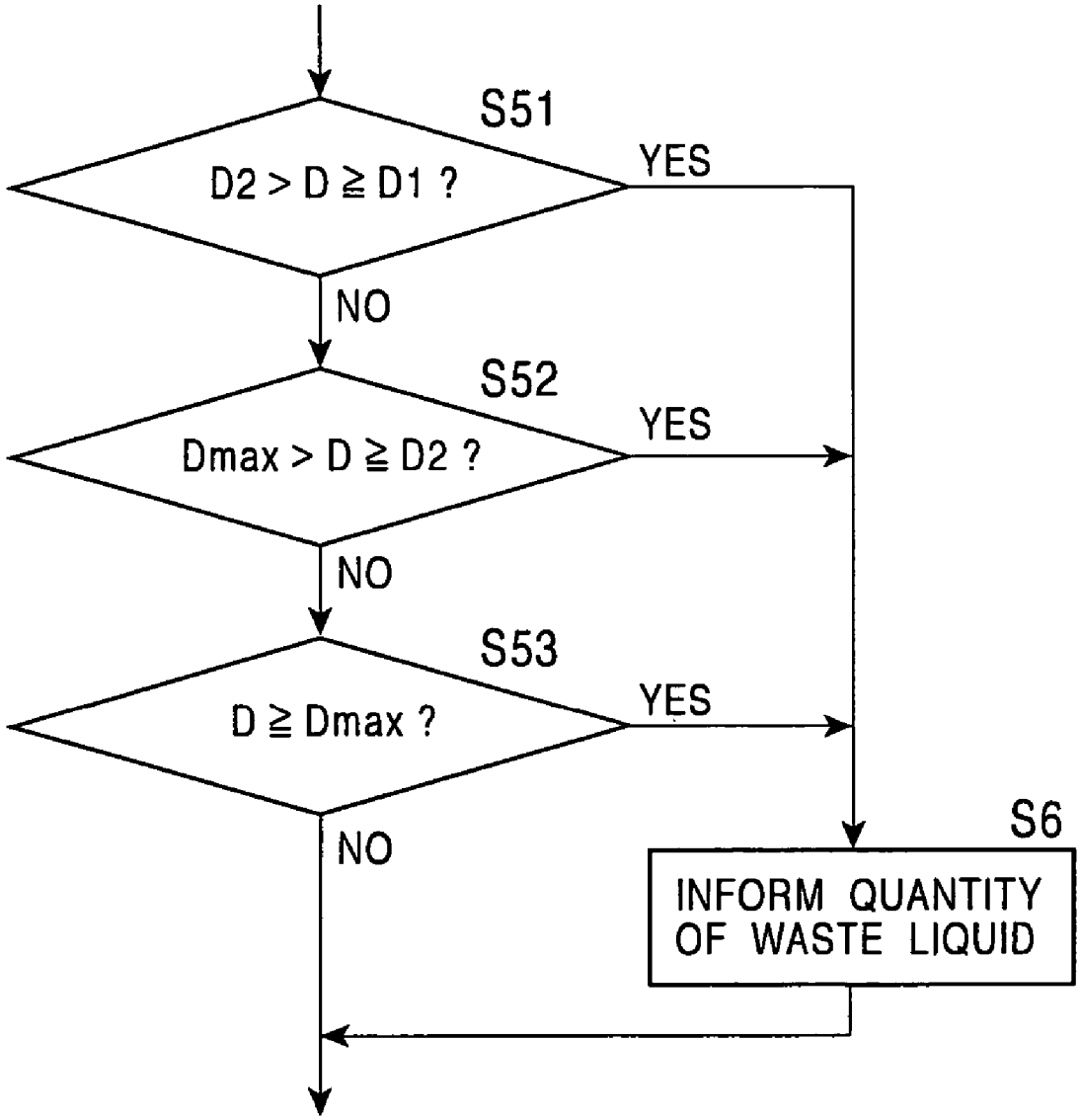
FIG. 4 is a flow chart explaining a multistep comparison in step S5 of FIG. 3.

The comparison between the quantity D and the upper limit Dmax in step S5 may be a multistep comparison, for example, a three-step comparison as shown in FIG. 4.

That is to say, as the upper limits on the quantity of the waste liquid, three steps D1, D2, and Dmax (D1<D2<Dmax) are set. Step S51 determines whether D2>D≧D1. Step S52 determines whether Dmax>D≧D2. Step S53 determines whether D≧Dmax. In step S6, if step S51 is YES, a message, for example, that the quantity of the waste liquid exceeds 90% is displayed; if step S52 is YES, a message, for example, that the quantity of the waste liquid exceeds 95% is displayed; and if step S53 is YES, a message, for example, that the quantity of the waste liquid exceeds 100% is displayed. Thus, a multistep notice concerning the quantity of the waste liquid can be performed according to the status of use, and the user can take action easily.

A liquid discharging apparatus including the above-described waste liquid quantity detecting device will now be described. This liquid discharging apparatus includes a liquid discharging head supplied with a predetermined type of liquid from a liquid container and held detachably in an apparatus body, the liquid discharging head having liquid discharging nozzles discharging the liquid to form dots or rows of dots.

The liquid discharging apparatus includes the waste liquid quantity detecting device shown in FIG. 2, and detects the quantity of the liquid wasted without being used for forming the dots or rows of dots.

Figure 5:
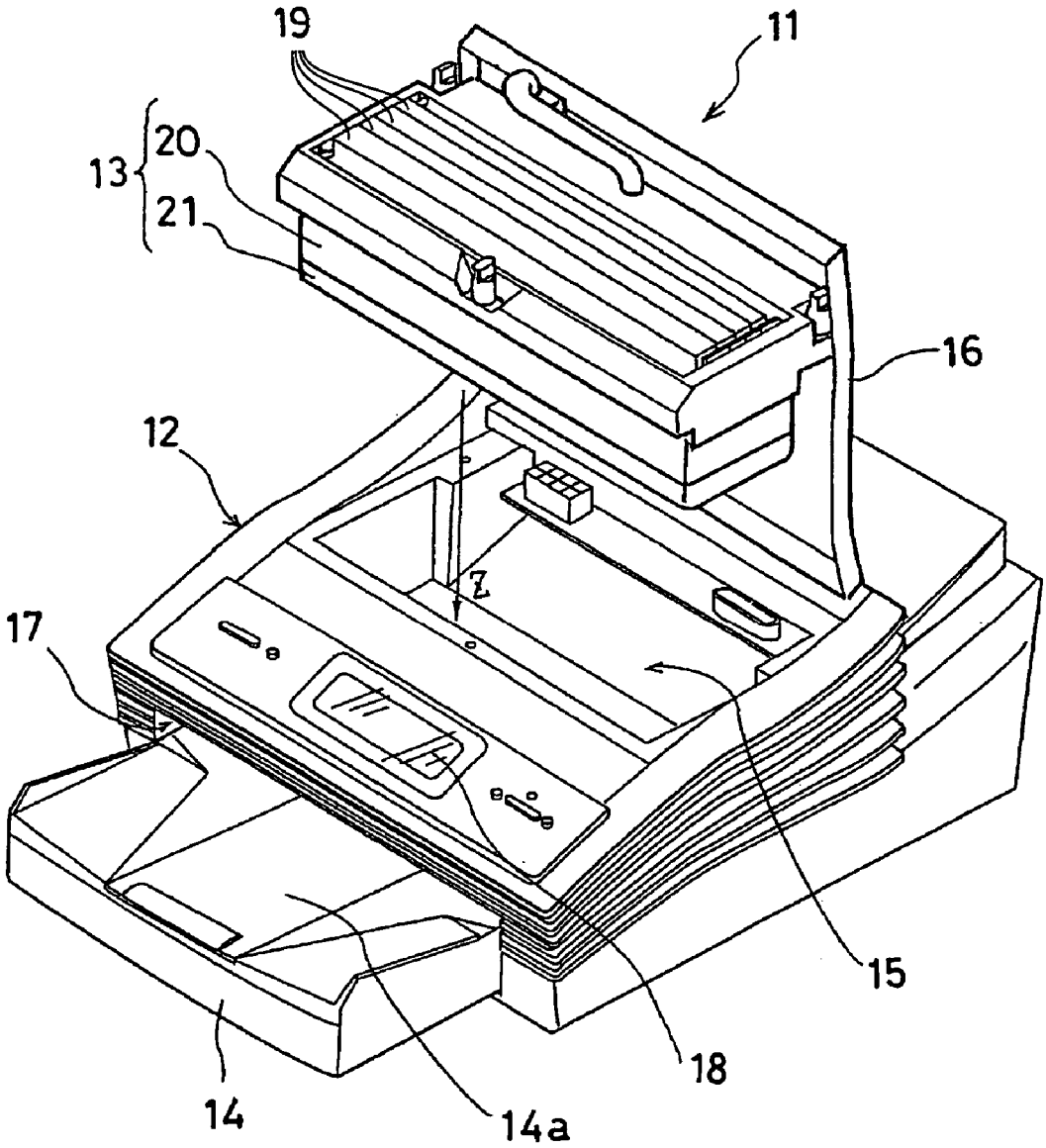
FIG. 5 is a perspective view showing an embodiment of an ink jet printer as an example of a liquid discharging apparatus according to the present invention.

FIG. 5 is a perspective view showing an embodiment of an ink jet printer as an example of a liquid discharging apparatus according to the present invention. This ink jet printer 11 discharges ink drops to a predetermined position of a recording media to form an image. This ink jet printer 11 has a printer body 12, a head cartridge 13, and a recording sheets tray 14.

The printer body 12 accommodates a recording sheet conveying mechanism and an electric circuit. In the upper surface of the printer body 12, an accommodating portion 15 accommodating the head cartridge 13 opens. The accommodating portion 15 is covered by a lid 16.

At the lower front of the printer body 12, a tray insertion slot 17 for accommodating the recording sheets tray 14 (to be described) is disposed. This tray insertion slot 17 also functions as an outlet for a recording sheet. At the upper front of the printer body 12, a display panel (display unit) 18 showing operation state of the entire ink jet printer 11 is disposed.

The accommodating portion 15 of the printer body 12 accommodates the head cartridge 13 as shown by arrow Z. The head cartridge 13 is detachable. This head cartridge 13 consists of a print head 20 and a head cap 21. The print head 20 has ink tanks 19 containing four colors of inks: yellow Y, magenta M, cyan C, and black K. The head cap 21 is placed on the lower surface of the print head 20. Here, the print head 20 is a full-line type having a long row of nozzles across the entire width of a recording sheet (for example, an A4 recording sheet).

The recording sheets tray 14 is attached detachably to the tray insertion slot 17. This recording sheets tray 14 accommodates stacked recording sheets. On the upper surface of the recording sheets tray 14, a sheet catcher 14*a* is disposed. The sheet catcher 14*a* catches the recording sheet coming out from the printer body 12.

Figure 6:
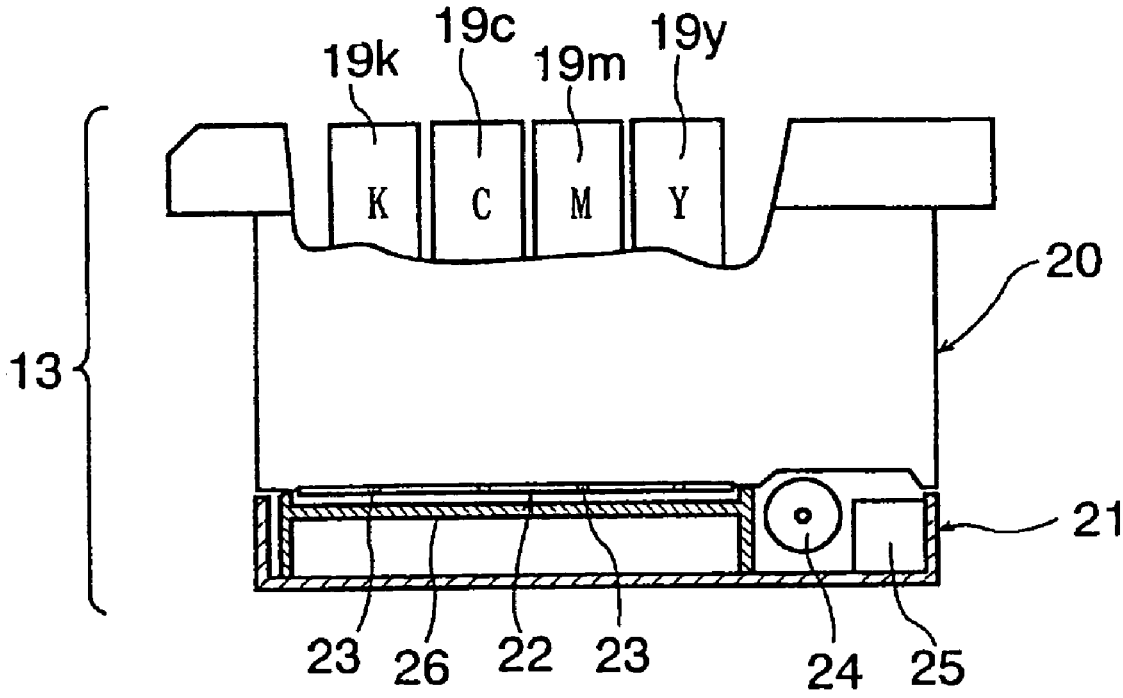
FIG. 6 is a partly sectional side view showing the structure of a head cartridge of the liquid discharging device.

FIG. 6 is a partly sectional side view showing the structure of the head cartridge 13. The ink tank 19 functions as a liquid container holding a predetermined type of liquid (ink). Four tanks 19*y*, 19*m*, 19*c*, and 19*k* containing four colors of inks Y, M, C, and K, respectively, are attached detachably.

The print head 20 is supplied with ink from the ink tanks 19*y*, 19*m*, 19*c*, and 19*k* and functions as a liquid discharging head. The lower surface of the print head 20 is a nozzle surface 22. The nozzle surface 22 has rows of ink discharging nozzles 23 discharging four colors of inks Y, M, C, and K.

Under the print head 20, the head cap 21 is placed removably. The head cap 21 can move relative to the print head 20. This head cap 21 protects the nozzle surface 22 of the print head 20. The head cap 21 is a long box with four walls. The head cap 21 accommodates a cleaning roller (cleaning member) 24 and a waste liquid receiver 25. The cleaning roller 24 moves on the nozzle surface 22 and wipes ink adhering thereon. When the nozzles 23 discharge ink in vain to prevent clogging, the waste liquid receiver 25 receives the discharged ink.

The cleaning roller 24 is made of elastic and moisture-absorbing material such as a sponge. The waste liquid receiver 25 is made of moisture-absorbing material such as a sponge. In the head cap 21, a nozzle shielding member 26 is disposed near the nozzle surface 22 of the print head 20.

Figure 7:
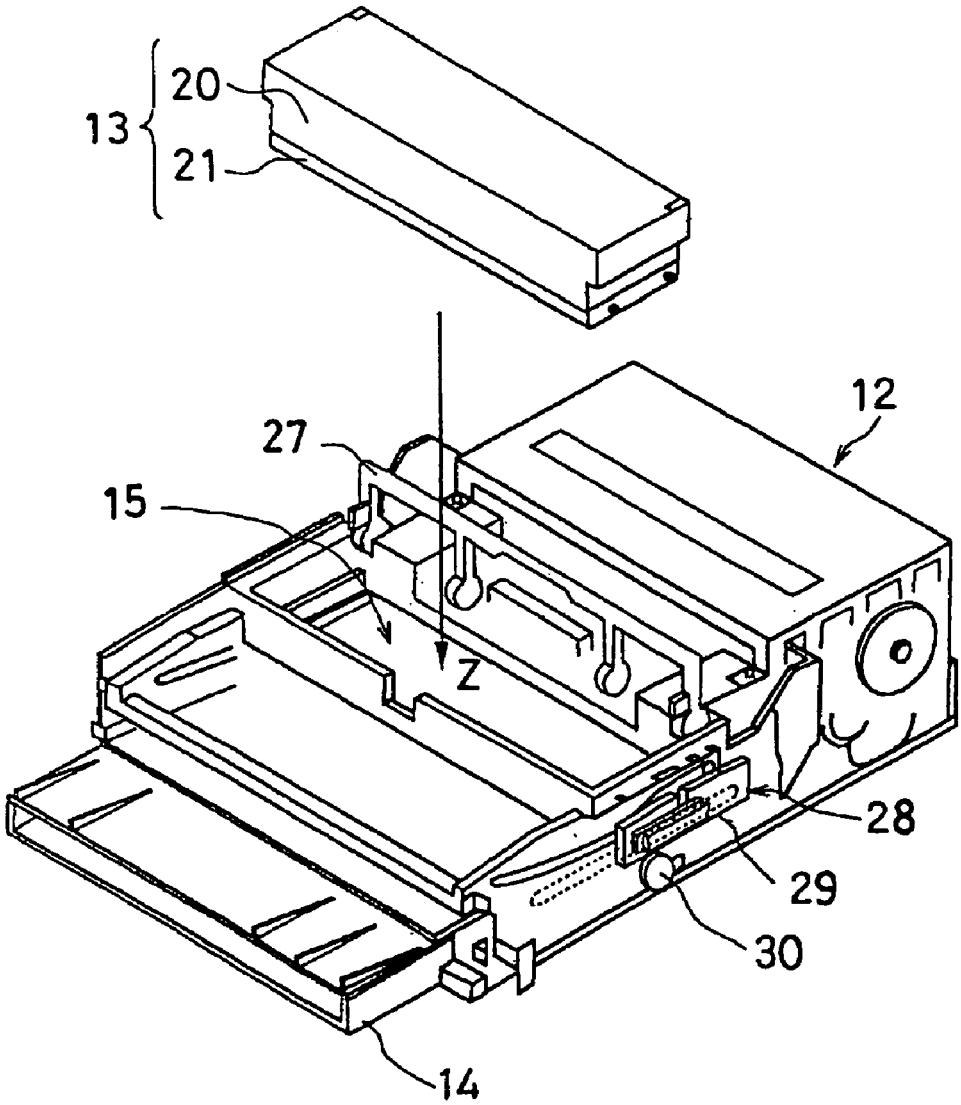
FIG. 7 is an explanatory view showing the internal structure of a printer body shown in FIG. 5 with the external cover removed.
Figure 8:
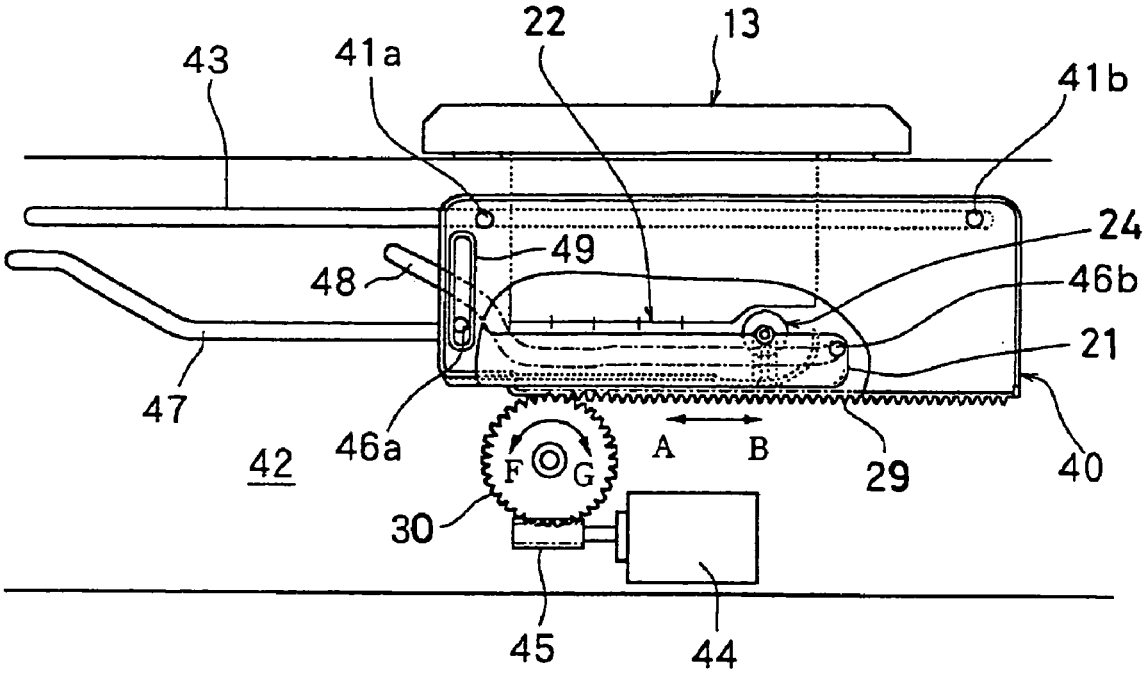
FIG. 8 is an explanatory view showing a head cap placing-and-removing mechanism shown in FIG. 7.

The moving structure of the head cap 21 will now be described with reference to FIGS. 7 and 8. FIG. 7 is an explanatory view showing the internal structure of the printer body 12 shown in FIG. 5 with the external cover removed. FIG. 8 is an explanatory view showing a head cap placing-and-removing mechanism 28.

In FIG. 7, the head cartridge 13 is accommodated in the accommodating portion,15 as shown with arrow Z. Then, a head holder 27 is rotated forward by an angle of 90 degrees to fix the head cartridge 13 to the printer body 12. At this time, the head cap 21 shown in FIG. 6 becomes engaged with the head cap placing-and-removing mechanism 28.

FIG. 8 is a side view showing the head cap placing-and-removing mechanism 28 shown in FIG. 7. As shown in FIG. 8, the head cap 21 is connected to a rack plate 40. A straight rack 29 is formed in the lower side of the rack plate 40.

This rack plate 40 is for moving the head cap 21 in the directions of arrows A and B. Two guide pins 41*a* and 41*b* are provided in the upper corners of the inner side of the rack plate 40. A straight guide groove 43 is provided in a side wall 42 of the printer body 12. The guide pins 41*a* and 41*b* are fitted in the guide groove 43. The rack 29 is engaged with a pinion 30. The pinion 30 is rotated by a motor 44 via a worm gear 45. Thus the rack plate 40 is supported.

On a side of the head cap 21, two-guide pins 46*a* and 46*b* are provided. The pins 46*a* and 46*b* project toward the rack plate 40. In the middle of a side wall of the printer body 12, two guide grooves 47 and 48 are provided. The guide grooves 47 and 48 have a predetermined curved shape to guide the head cap 21.

The guide pins 46*a* and 46*b* of the head cap 21 are fitted in the guide grooves 47 and 48, respectively. The front guide pin 46*a* is fitted in a vertical guide groove 49 in the rack plate 40.

The pinion 30 is rotated in the directions of arrows F and G by the motor 44 via the worm gear 45. Since the rack 29 engages with the pinion 30, the rack plate 40 moves in the directions of arrows A and B. Since the front guide pin 46*a* is fitted in the guide groove 49 at the front of the rack plate 40, the head cap 21 moves, in the directions of arrows A and B together with the rack plate 40. The movement of the head cap 21 is restricted by the shape of the guide grooves 47 and 48 in which the two guide pins 46*a* and 46*b* are fitted, respectively.

Figure 9A:
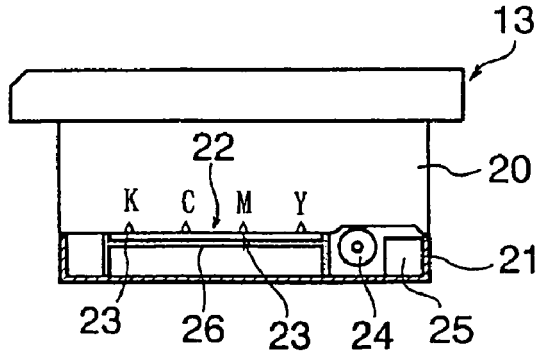
FIGS. 9A to 9E are explanatory views showing the cleaning operation when the head cap is moved by the head cap placing-and-removing mechanism.

Next, the cleaning operation of the head cap 21 moved by the head cap placing-and-removing mechanism 28 will now be described with reference to FIGS. 9A to 9E. FIG. 9A shows the initial state in which the head cap 21 completely covers the nozzle surface 22 of the print head 20, and the ink discharging nozzles 23 of four colors Y, M, C, and K are protected by the nozzle shielding member 26.

Figure 9B:
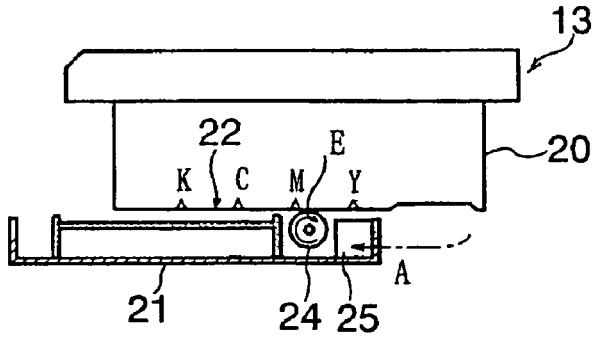

When the printer starts up, when printing starts, or when the user instructs, a cap removing trigger signal is input into the printer body 12. If the cap removing trigger signal is input, the motor 44 shown in FIG. 8 rotates, so that, as shown in FIG. 9B, the head cap 21 starts moving in the direction of arrow A. With the movement of the head cap 21, the cleaning roller 24 made of, for example, a sponge rotates, moves, and wipes the nozzle surface 22. When the cleaning roller 24 rotates and moves, it wipes the solidified or thickened ink from the ink discharging nozzles 23 of four colors Y, M, C, and K.

If a sensor such as an optical sensor or a mechanical sensor detects that the waste liquid receiver 25 made of, for example, a sponge reaches just beneath the ink discharging nozzle 23 wiped by the cleaning roller 24, the ink discharging nozzle 23 discharges ink in vain in order to prevent clogging. In FIG. 9B, a yellow Y ink discharging nozzle 23 is wiped by the cleaning roller 24 and discharges ink toward the waste liquid receiver 25 just beneath the yellow Y ink discharging nozzle 23.

Figure 9C:
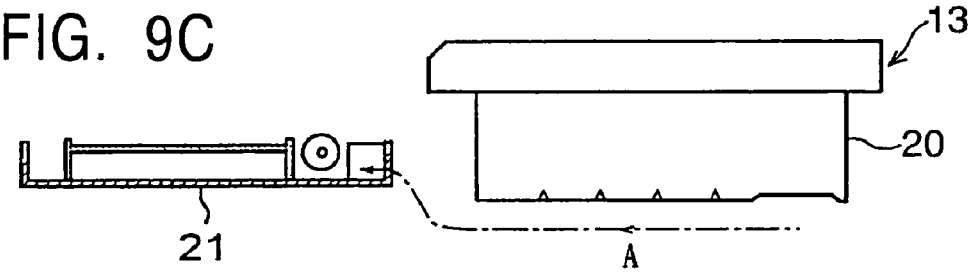

In this way, all ink discharging nozzles 23 of four colors Y, M, C, and K are wiped by the cleaning roller 24 and discharge ink in vain. Then, as shown in FIG. 9C, the head cap 21 fully moves in the direction of arrow A to settle in a withdrawal position. In this state, the printer body 12 and the head cartridge 13 can perform printing.

Figure 9D:
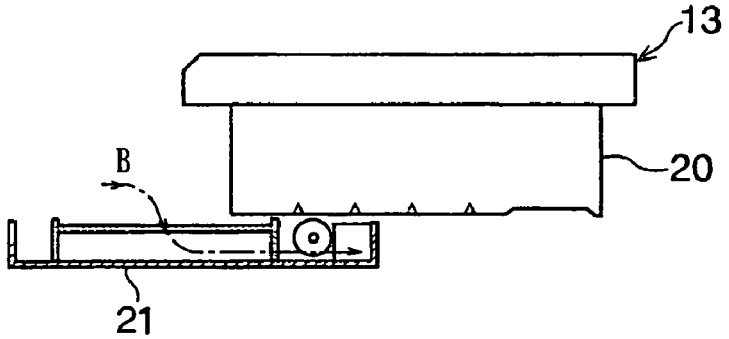

When a predetermined printing is completed, a head cap placing trigger signal is input into the printer body 12, so that the motor 44 shown in FIG. 8 rotates in the reverse direction. As shown in FIG. 9D, the head cap 21 moves in the direction of arrow B from the withdrawal position to the original position through the same route as in the uncovering operation. In this covering operation, the cleaning roller 24 does not wipe the ink discharging nozzles 23 and the ink discharging nozzles 23 do not discharge ink in vain. This is in order to give the cleaning roller 24 a longer life and to delay the replacement.

Figure 9E:
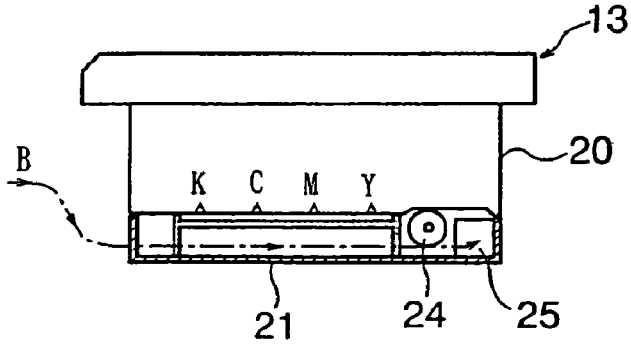

As shown in FIG. 9E, the head cap 21 fully moves in the direction of arrow B and returns to the initial state shown in FIG. 9A.

Figure 10:
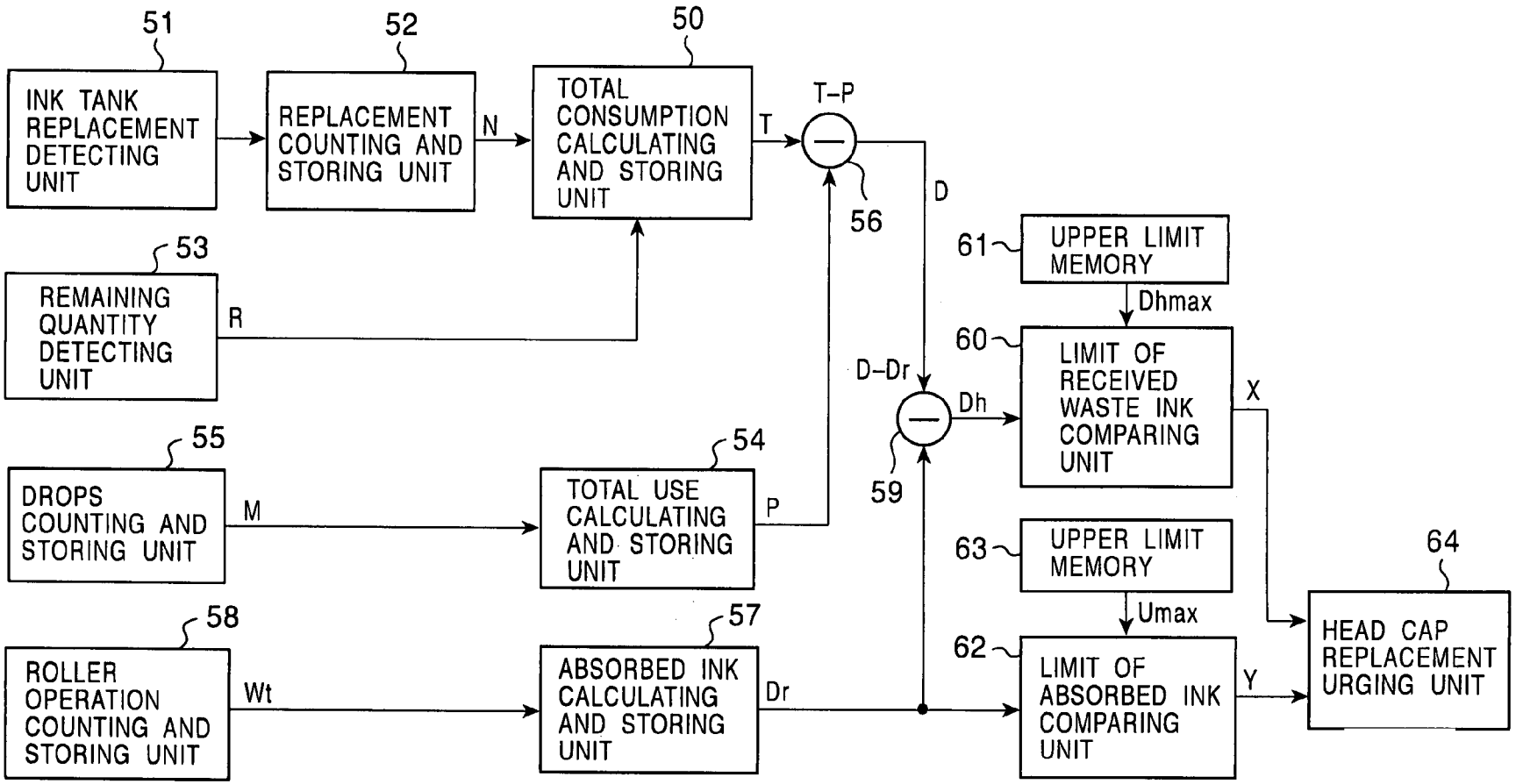
FIG. 10 is a block diagram showing the internal structure of the detecting device included in the ink jet printer shown in FIG. 5.

FIG. 10 is a block diagram showing the internal structure of the detecting device included in the ink jet printer shown in FIG. 5. In FIG. 10, a total consumption calculating and storing unit 50 accumulates ink consumption for a period from the start of using an ink tank up to the present to obtain and store total consumption T. Its inputs are connected with an ink tank replacement detecting unit 51, a replacement counting and storing unit 52, and a remaining quantity detecting unit 53.

The total consumption calculating and storing unit 50, the ink tank replacement detecting unit 51, the replacement counting and storing unit 52, and the remaining quantity detecting unit 53 correspond to the total consumption calculating and storing unit 1, the container replacement detecting unit 6, the replacement counting and storing unit 7, and the remaining quantity detecting unit 8 shown in FIG. 2, respectively.

The total consumption calculating and storing unit 50 calculates the total consumption T of the ink according to formula (1):

$$T=V(N+1)-R \tag{1}$$

where the capacity V of the ink tank is known, the number N of times of replacing the ink tank is received as a signal from the replacement counting and storing unit 52, and the remaining quantity R of the ink in the current ink tank is received as a signal from the remaining quantity detecting unit 53.

Although, in FIG. 10, the total consumption calculating and storing unit 50 calculates the total consumption T of the ink from the number N of times of "replacing" the ink tank, the present invention is not limited to this. The total consumption calculating and storing unit 50 may calculate the total consumption T of the ink from the number N of times of "refilling" the ink tank. In this case, an ink "refilling" detecting unit is provided instead of the ink tank replacement detecting unit 51, and a "refilling" counting and storing unit is provided instead of the replacement counting and storing unit 52.

A total use calculating and storing unit 54 accumulates and stores the quantity of the ink used for the operation by the operation unit for the period from the start of using the ink tank up to the present to obtain the total use P. Its inputs are connected with a drops counting and storing unit 55.

The total use calculating and storing unit 54 and the drops counting and storing unit 55 correspond to the total use calculating and storing unit 2 and the drops counting and storing unit 9 shown in FIG. 2, respectively.

The total use calculating and storing unit 54 calculates the total use P of the ink according to formula (2):

$$P=M\cdot L \tag{2}$$

where the total count M of drops of the ink used for forming dots or rows of dots by the ink discharging nozzles 23 is received as a signal from the drops counting and storing unit 55, and L is the volume of a drop of the ink.

A first calculating unit 56 subtracts the total use P from the total consumption to obtain quantity D of the waste ink discharged in vain to the waste ink receiver 25 of the head cap 21 shown in FIG. 6. It is, for example, a subtracter. It calculates the quantity D of the waste ink according to formula (3):

$$D=T-P \tag{3}$$

and outputs a signal of the calculation result.

An absorbed ink calculating and storing unit 57 calculates the quantity Dr of the ink absorbed by the cleaning roller 24 when the cleaning roller 24 wipes the nozzle surface 22 shown in FIG. 6. Its inputs are connected with a roller operation counting and storing unit 58.

The roller operation counting and storing unit 58 counts the times of operation of the cleaning roller 24 wiping the nozzle surface 22 and stores the counted value. It counts the number of driving signal for moving the head cap 21 shown in FIGS. 9A to 9E, and outputs a signal of the total number Wt of times of operation of the cleaning roller 24.

The absorbed ink calculating and storing unit 57 calculates the quantity Dr of the ink absorbed by the cleaning roller 24 according to formula (4):

$$Dr=Wt\cdot k \tag{4}$$

where the number Wt of times of operation of the cleaning roller 24 is obtained from the signal from the roller operation counting and storing unit 58, and k is the quantity of ink absorbed per wipe of the cleaning roller 24.

Since Dr is proportional to Wt, Dr may be obtained from Wt alone. Alternatively, Dr may be calculated from Wt according to a predetermined function formula (Dr=F(Wt)).

A second calculator 59 is for accumulating the quantity Dh of the liquid received by the waste liquid receiver 25 of the head cap 21. It is, for example, a subtracter.

Since Dh can be obtained by subtracting Dr from D, the second calculating unit 59 calculates Dh according to formula (5):

$$Dh=D-Dr \tag{5}$$

and outputs a signal of the calculation result.

A limit of received waste ink comparing unit 60 is for comparing the quantity Dh of waste ink calculated in the second calculating unit 59 with a predetermined upper limit Dhmax on the quantity Dh of waste ink received in the waste ink receiver 25. It is, for example, a comparator.

The unit 60 receives a signal of the quantity Dh output from the second calculating unit 59. In addition, the unit 60 reads out the upper limit Dhmax stored in an upper limit memory 61. The unit 60 compares them, and if the comparison result exceeds a predetermined value, it outputs a comparison result signal X.

In this case, the comparison result between the quantity Dh and the upper limit Dhmax is whether Dh is greater than Dhmax or not, the differential between Dh and Dhmax, or the proportion of Dh to Dhmax. If Dh≧Dhmax, if the differential between Dh and Dhmax exceeds a predetermined value, or if the proportion of Dh to Dhmax exceeds a predetermined value, a comparison result signal X is output. The comparison result signal X may be output if the differential between Dh and Dhmax becomes 0, or if the proportion of Dh to Dhmax becomes 1.

A limit of absorbed ink comparing unit 62 receives Dr calculated in the absorbed ink calculating and storing unit 57 and compares the Dr with a predetermined upper limit Umax on the quantity Dr of the ink absorbed by the cleaning roller 24. It is, for example, a comparator.

The unit 62 receives a signal of the quantity Dr output from the absorbed ink calculating and storing unit 57. The unit 62 reads out the upper limit Umax stored in an upper limit memory 63. The unit 62 compares them, and if the comparison result exceeds a predetermined value, it outputs a comparison result signal Y.

In this case, the comparison result between the quantity Dr and the upper limit Umax is whether Dr is greater than Umax or not, the differential between Dr and Umax, or the proportion of Dr to Umax. If Dr≧Umax, if the differential between Dr and Umax exceeds a predetermined value, or if the proportion of Dr to Umax exceeds a predetermined value, a comparison result signal Y is output. The comparison result signal Y may be output if the differential between Dr and Umax becomes 0, or if the proportion of Dr to Umax becomes 1.

A head cap replacement urging unit 64 receives the comparison result signal X from the limit of received waste ink comparing unit 60 and the comparison result signal Y from the limit of absorbed ink comparing unit 62, and urges to replace the head cap 21. The unit 64 is, for example, a warning sound maker such as a buzzer, a warning light, or a warning display such as a display panel.

If the unit 64 receives the signal X or Y, it urges to replace the head cap 21.

Alternatively, the unit 62 may calculate the proportion Y' of the number Wt of times the cleaning member 24 shown FIG. 9 wipes the nozzle surface 22 to a predetermined upper limit Wtmax on the number Wt of times, and the unit 60 may calculate the proportion X' of the quantity Dh of the waste ink received by the waste liquid receiver 25 to a predetermined upper limit Dhmax on the quantity Dh. The signals of proportions X' and Y' are sent to the unit 64. The unit 64 gives multistep notice concerning time to replace the head cap 24 on the basis of the higher proportion X' or Y'.

The operation of the wasted liquid quantity detecting device for an ink jet printer will now be described with reference to the flow chart of FIG. 11. When the printer starts up, when printing starts, or when the user instructs, an execution signal of cleaning of the nozzle surface 22 shown in FIG. 6 is input into the printer body 12. The remaining quantity detecting unit 53 shown in FIG. 10 detects the remaining quantity R of ink in the ink tank (step S11) in order to calculate the total consumption of ink.

The remaining quantity detecting unit 53 detects the remaining quantity R of ink in the current ink tank.

Next, the total consumption calculating and storing unit 50 receives a signal of the number N of times of replacing the ink tank from the replacement counting and storing unit 52, and a signal of the remaining quantity R of the ink in the current ink tank from the remaining quantity detecting unit 53. Then, the unit 50 calculates the total consumption of ink according to the formula (1) (step S12).

Next, the total use calculating and storing unit 54 receives a signal of the accumulated total count M of ink drops used for forming dots or rows of dots for printing from the drops counting and storing unit 55. Then, the total use calculating and storing unit 54 calculates the total use of ink according to the formula (2) (step S13).

Next, the first calculating unit 56 subtracts the total use P from the total consumption T to obtain the waste ink quantity D discharged in vain to the waste liquid receiver 25 of the head cap 21 shown in FIG. 6 (step S14).

Next, the absorbed ink calculating and storing unit 57 receives a signal of the number Wt of times of operation of the cleaning roller 24 from the roller operation counting and storing unit 58, and calculates the quantity Dr of ink absorbed by the cleaning roller 24 (step S15).

Next, the second calculating unit 59 receives the quantity D of the waste ink discharged in vain from the ink discharging nozzles 23 to the waste liquid receiver 25 from the first calculating unit 56, and the quantity Dr of ink absorbed by the cleaning roller 24 when the cleaning roller 24 wipes the nozzle surface 22 from the absorbed ink calculating and storing unit 57. Then the second calculating unit 59 subtracts Dr from D to obtain the quantity Dh of the waste ink received by the waste liquid receiver 25 of the head cap 21 (step S16).

Next, the limit of received waste ink comparing unit 60 compares the quantity Dh calculated in the second calculating unit 59 with a predetermined upper limit Dhmax on the quantity Dh, and determines whether Dh≧Dhmax or not (step S17). If Dh≧Dhmax (YES), the operation is skipped to step S19. If Dh<Dhmax (NO), the operation is skipped to step S18.

In step S18, the limit of absorbed ink comparing unit 62 compares the quantity Dr of ink absorbed by the cleaning roller 24 calculated in the absorbed ink calculating and storing unit 57 with a predetermined upper limit Umax on the quantity Dr, and determines whether Dr≧Umax. If Dr<Umax (NO), printing is continued. If Dr≧Umax (YES), the operation is skipped to step S19.

In step S19, if the signal X or Y is input, the head cap replacement urging unit 64 urges to replace the head cap 21.

In this case, the signal output from the head cap replacement urging unit 64 is sent to, for example, the display panel 18 provided in the printer body 12 shown in FIG. 5. Then, a warning indicator lights up, or a message urging to replace the head cap 21 is displayed.

Figure 12:
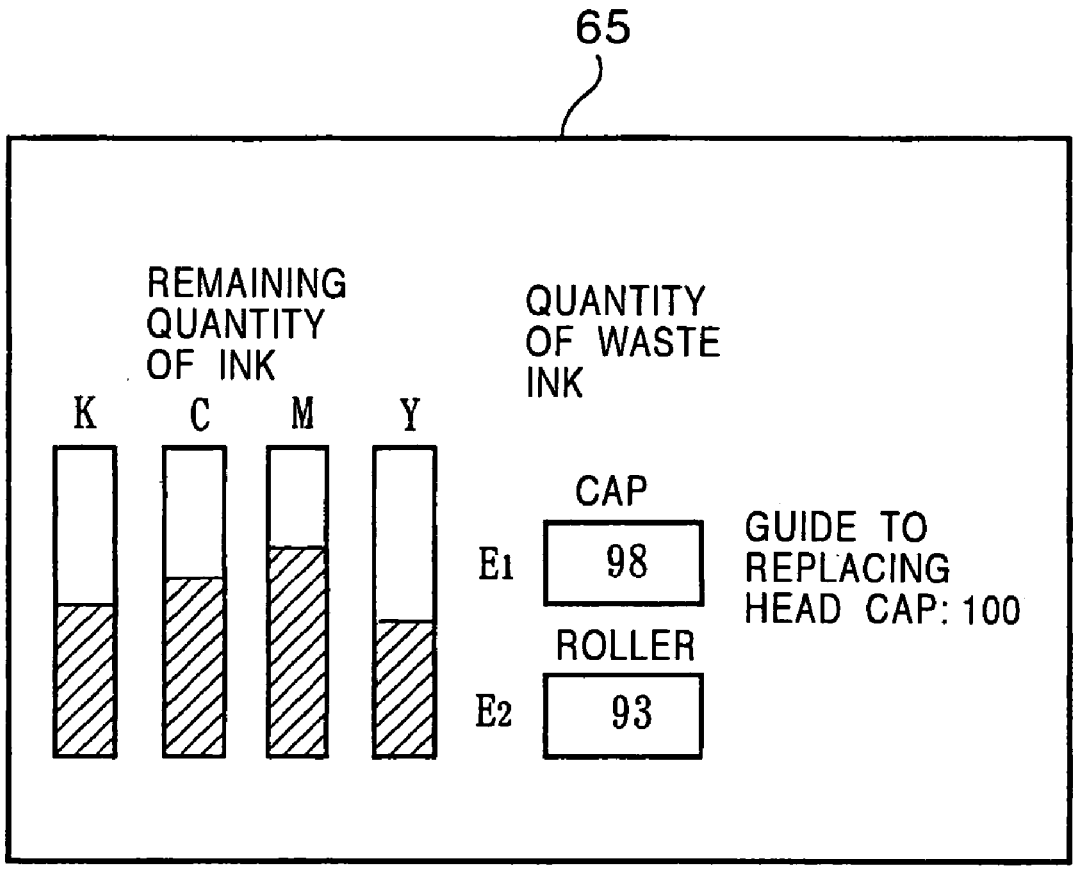
FIG. 12 is an explanatory view showing a dialog box on a display of an information processor connected to the printer body, the signal output from a head cap replacement urging unit being sent to the display.

Alternatively, the signal output from the head cap replacement urging unit 64 may be sent to a display of an information processor (for example, a computer) connected to the printer body 12 and displaying the contents of information processing. In this case, as shown in FIG. 12, an index E1 showing Dh (for example, E1=98) and another index E2 showing Dr (for example, E2=93) are displayed in a dialogue box 65 on the screen.

In addition, "100" is displayed as a guide to replacing the head cap. When the index E1 or E2 becomes "100", the user replaces the head cap 21. In this way, the user can replace the head cap 21 at the right time.

In this case, it is preferable to provide the memories storing values not in the computer but in the ink jet printer 11. This is because the ink jet printer 11 can be connected with another computer.

Figure 11:
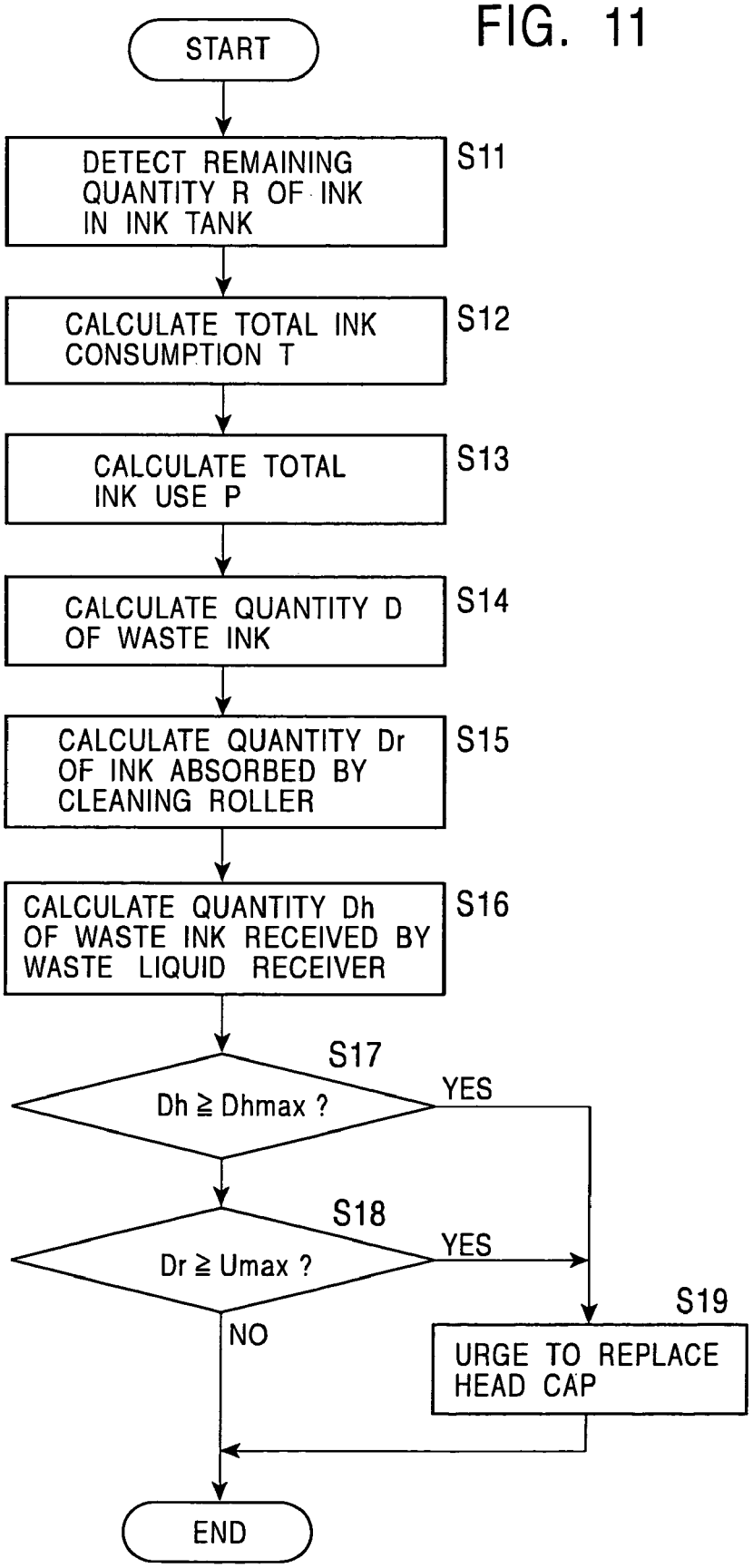
FIG. 11 is a flow chart explaining the operation of the detecting device of the ink jet printer.

The determinations in steps S17 and S18 shown in FIG. 11 may be multistep determinations such as the three-step determination in step S5 shown in FIG. 4. Thus, multistep notice concerning time to replace the head cap 21 can be performed according to the status of use, and the user can take action easily.

When the head cap 21 is replaced, the values accumulated in the memories is reset according to the status of use of the ink jet printer 11. The resetting of values is performed manually by pushing a reset button. Alternatively, it may be performed automatically by a replacement detector provided in the printer body 12.

Although the present invention is applied to an ink jet printer in the above description, the present invention is not limited to this. The present invention may be applied to any apparatus that has a liquid container holding liquid and discharges the liquid in the form of drops from a liquid discharging nozzle. The present invention may be applied to other ink jet image forming machines such as a facsimile machine and a copying machine.

The liquid discharged from the liquid discharging nozzle is not limited to ink. The present invention can be applied to an apparatus discharging other liquid if they form dots or rows of dots. The present invention can be applied to, for example, a liquid discharging apparatus discharging solution containing DNA to a pallet in a DNA determination.

What is claimed is:

1. A method for detecting a quantity of waste liquid which is not used in a predetermined operation when a predetermined type of liquid is supplied from a liquid container to an operation unit performing the predetermined operation and is consumed, the method comprising the steps of:

accumulating liquid consumption for a period from the start of using the liquid container up to the present to obtain total consumption (T), wherein the total consumption (T) of the liquid is calculated according to the formula $$T=V(N+1)-R$$

where V is the capacity of the liquid container, N is the number of times of refilling or replacing the liquid container, and R is the quantity of the liquid remaining in the current liquid container, the quantity being detected by a liquid remaining-quantity detector provided in the liquid container;

accumulating liquid quantity used for the operation by the operation unit for the period to obtain total use (P);

subtracting the total use (P) from the total consumption (T); and obtaining quantity (D) of the waste liquid by regarding the subtraction result (T-P) as the quantity (D) of the waste liquid.

2. The method according to claim 1, wherein the total use (P) of the liquid is calculated according to the formula $$P=M\cdot L$$

where M is the total number of drops of the liquid used for the operation by the operation unit, and L is the volume of a drop of the liquid.

* * * * *